US006137413A

United States Patent [19]

Ryan, Jr.

[11] Patent Number: 6,137,413

[45] Date of Patent: Oct. 24, 2000

[54] CAP WITH INTEGRATED EAS MARKER

[75] Inventor: Joseph M. Ryan, Jr., Atlantis, Fla.

[73] Assignee: Sensormatic Electronics Corporation, Boca Raton, Fla.

[21] Appl. No.: 09/182,022

[22] Filed: Oct. 29, 1998

[51] Int. Cl.[7] ..... G08B 13/14

[52] U.S. Cl. ..... 340/572.8; 340/572.1; 340/572.5; 340/572.6

[58] Field of Search ..... 340/572.8, 572.7, 340/572.6, 572.5, 572.9, 551

[56] References Cited

U.S. PATENT DOCUMENTS

| | | | |
|---|---|---|---|
| 4,813,564 | 3/1989 | Cooper et al. | 340/572.5 |
| 5,602,530 | 2/1997 | Holmgren | 340/572.1 |
| 5,625,347 | 4/1997 | MacLean et al. | 340/693.9 |
| 5,729,200 | 3/1998 | Copeland et al. | 340/572.6 |
| 5,777,553 | 7/1998 | Perreau et al. | 340/572.5 |

*Primary Examiner*—Jeffery A. Hofsass
*Assistant Examiner*—John Tweel, Jr.
*Attorney, Agent, or Firm*—Robin, Blecker & Daley

[57] ABSTRACT

A cap for a bottle to be protected from theft includes a covering portion for covering an opening of the bottle and an electronic article surveillance ("EAS") marker. The covering portion has a surface and a wall that extends downward from the surface and along a circumference of the surface. The EAS marker comprises a circular disk positioned within a cavity defined by an inner surface of the wall of the covering portion and a marker element attached to and extending downward from the circular disk. The marker element is insertable through the opening of the bottle and provides a signal that is detectable by an electronic article surveillance system.

35 Claims, 3 Drawing Sheets

CAP WITH INTEGRATED EAS MARKER

FIELD OF THE INVENTION

This invention relates generally to electronic article surveillance ("EAS"), and more particularly, to techniques for securing EAS markers to goods that are to be protected from theft.

BACKGROUND OF THE INVENTION

It is known to provide electronic article surveillance systems in which detecting devices are installed at the exits of retail stores. EAS markers that are detectable by the detecting devices are secured to articles of merchandise that are to be protected from theft. When a customer pays for an article of merchandise, the EAS marker secured to the article of merchandise is either removed or deactivated according to known techniques. The article can then be carried past the detecting devices without actuating an alarm.

Articles of merchandise in the form of bottles, and particularly wine bottles or other beverage bottles, present particular challenges in terms of securing EAS markers to the bottles. For the most part, EAS markers are provided in a form that is suitable for attachment to a large flat surface, such as the cover of a jewel case for a compact disc, or in a device that is attachable to soft goods, such as clothing. A wine bottle, however, lacks flat surfaces to which conventional EAS markers can be readily attached and does not provide for easy attachment as with clothing.

French Patent Application No. 2,703,659 ("'659 French Application") proposes a bottle cap arrangement for a wine bottle, with an anti-theft circuit mounted in the cap arrangement at a position above the opening of the bottle. More particularly, the anti-theft circuit is sandwiched between the upper surface of a disk that covers the opening of the bottle and a circular base of a capsule that covers the disk as well as the neck of the bottle. This anti-theft circuit shown in the '659 French Application, however, appears to be incompatible with the most widely installed types of EAS detection equipment, and also appears to be of a type that would be masked and rendered ineffective if the top of the bottle is covered with metal foil or metal cap, as is often done with champagne and wine. Furthermore, the anti-theft circuit is limited to its placement between the disk covering the opening of the bottle and the circular base of the capsule.

French Patent No. 95 12402 ("'402 Patent"), issued to Dameme and commonly assigned with the present application, also proposes an arrangement for protecting a bottle from theft, but unlike the '659 French Application, uses an electronic article surveillance marker mounted in a bottle cover covering the top and neck of a bottle. Such a bottle protection arrangement, however, may not protect a bottle from theft if the bottle cover is torn revealing the EAS marker or the bottle cover and marker are removed from the bottle. This arrangement also is not suitable for protecting bottles that are sold without covers.

It is accordingly an object of the invention to provide an improved technique for securing an EAS marker to a bottle to be protected from theft.

It is a more particular object of the invention to provide a technique for integrating in a cap or lid of a bottle an EAS marker that is compatible with an installed base of EAS detection equipment.

It is a further object of the invention to provide a technique for integrating an EAS marker in a cap or lid of a bottle so as to decrease the marker's visibility.

SUMMARY OF THE INVENTION

In accordance with the principles of the present invention, the above and other objectives are realized in a cap for a bottle to be protected from theft, the cap comprising a covering portion and an electronic article surveillance ("EAS") marker. The covering portion has a surface and a wall that extends downward from the surface and along a segment of the surface. The EAS marker comprises an attachment portion or a disk-shaped member for attaching the EAS marker to the covering portion and a marker element attached to the disk-shaped member for providing a signal that is detectable by an electronic article surveillance system. The disk-shaped member is positioned within a cavity defined by the inner surface of the wall of the covering portion and the marker element is positioned perpendicular to and extends downward from the disk-shaped member. The bottle itself has an opening at the top and a neck portion that extends downward from the opening. The marker element is insertable through the opening into the neck portion of the bottle.

The marker element of the EAS marker provided according to the above aspects of the invention may be a magnetostrictive member and a biasing member mounted spaced apart from the magnetostrictive material. The biasing member, when magnetically biased, causes the magnetostrictive member to be mechanically resonant when exposed to an alternating electromagnetic field generated at a selected frequency by an electronic article surveillance system. The marker element of the present invention may also include a continuous strip of magnetic material or a marker suitable for radio frequency or microwave EAS systems.

In a further aspect of the invention, the disk-shaped member of the EAS marker is attached to a bottom surface of the covering portion and the marker element attached to the disk-shaped member is insertable through the opening into the neck portion of the bottle.

In the present invention, there is also provided a method of forming a cap to cover an opening of a bottle to be protected from theft. The method comprises the steps of providing a covering portion for covering the opening of the bottle and positioning an attachment portion of an EAS marker within a cavity defined by an inner surface of a wall of the covering portion. The EAS marker further comprises a marker element that is attached to and extends downward from the attachment portion for insertion through the opening of the bottle in order to provide a signal that is detectable by an electronic article surveillance system.

Another method of the present invention provides for an attachment portion of the EAS marker to be attached to a bottom surface of a covering portion of the cap with the marker element attached to the disk-shaped member being insertable through the opening into the neck portion of the bottle.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

FIGS. 1–5 show the EAS marker 10 in accordance with the principles of the present invention. In the present illustrative case, the EAS marker 10 is attachable to a variety of different types of caps or lids for bottles or containers. Indeed, the EAS marker 10 is easily integrated into or attached to a cap and then inserted through the opening of the bottle into the neck portion of a bottle to permit concealment of the EAS marker 10 to shoppers in an EAS environment.

Figure 1:
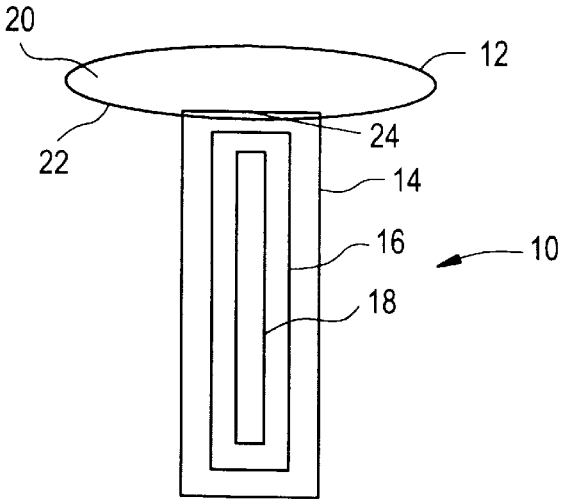
FIG. 1 shows a schematic side view of the EAS marker of the present invention.

This ease of attachment and concealment of the EAS marker 10 is based upon its T-shaped structure (as seen in a side view). With reference to FIG. 1, the EAS marker 10 comprises an attachment portion or disk-shaped member 12 and a box-like housing or support 14 in which is disposed an active marker element comprising an active or magneto-mechanical element 16 and magnetic biasing element 18. These elements in the housing 14 cooperate to generate a detectable signal in the manner disclosed in U.S. Pat. No. 4,510,489 issued to Anderson et al., the teachings of which are incorporated herein by reference. As illustrated in FIG. 1, the disk-shaped member 12 has top and bottom surfaces 20 and 22 with an edge 24 of the housing 14 being attached to the disk-shaped member's bottom surface 22. The housing 14 with the elements 16 and 18 therein is positioned perpendicular to the disk-shaped member's bottom surface 22 and extends downward to form the T-shaped structure of the EAS marker 10 as shown in FIG. 1.

Figure 2:
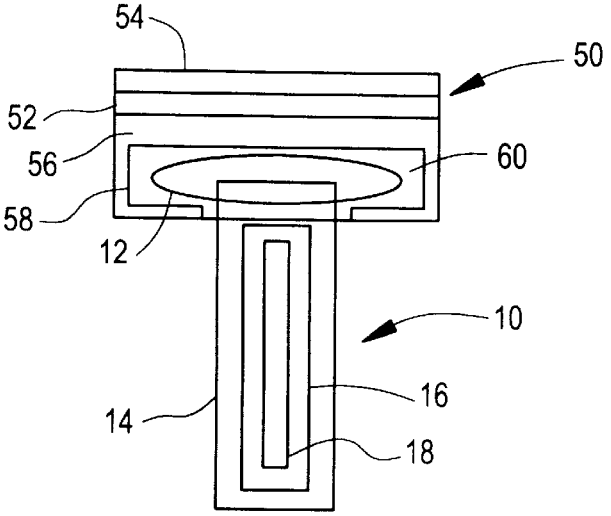
FIG. 2 shows a schematic side view of the EAS marker of FIG. 1 incorporated in a cap of a bottle.
Figure 3:
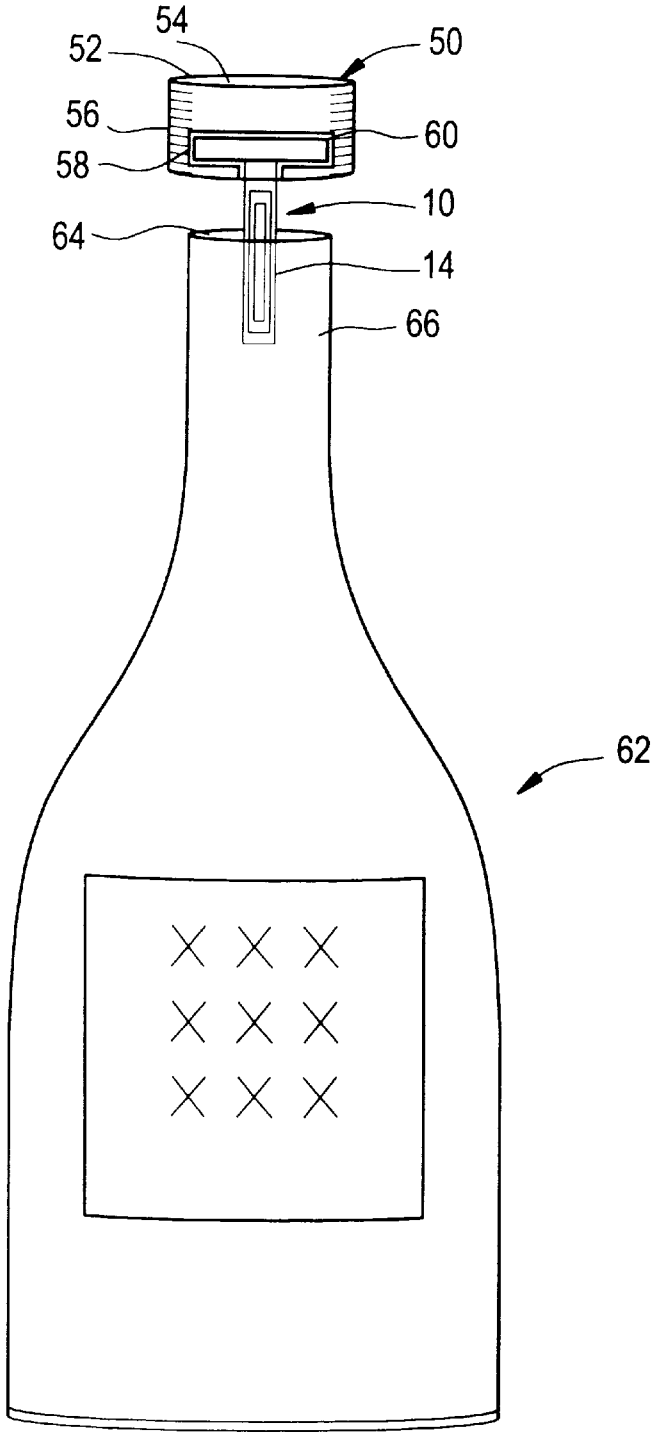
FIG. 3 shows a schematic side view of a bottle with the EAS marker and cap of FIG. 2 inserted in the neck of the bottle.

In particular, the positioning of the disk-shaped member 12 relative to the housing 14 allows for integration of the marker 10 with the cap 50 as shown in FIG. 2. As FIGS. 2 and 3 illustrate, the cap has a covering portion 52 that covers an opening 64 of the bottle 62. The covering portion 52 has a surface 54 and a wall 56 extending downward from the surface 54 and along a circumference of the surface 54. The wall 56 has an inner surface 58. The EAS marker 10 is integrated in the cap 50 by the disk-shaped member 12 being inserted into a cavity 60 defined by the inner surface 58 of the wall 56 of the covering portion 52. The disk-shaped member 12 having a slightly smaller diameter than compared to the diameter of the cap 50 allows for such insertion and integration. With the disk-shaped member 12 of the EAS marker 10 inserted in the cavity 60, as shown in FIG. 2, the housing 14 with the magneto-mechanical element 16 and magnetic biasing element 18 disposed therein extends perpendicular to and downward from the disk-shaped member 12.

FIG. 3 shows the EAS marker 10 integrated in the cap 50 and being inserted through an opening 64 into a neck portion 66 of the bottle 62. Accordingly, when the cap 50 is positioned on the bottle 62, the EAS marker 10 extends vertically downwardly in the neck portion 66 of the bottle 62.

Figure 4:
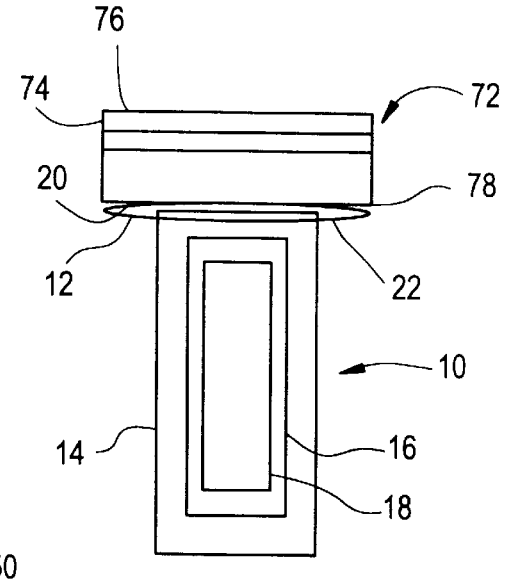
FIG. 4 shows a schematic side view of the EAS marker of FIG. 1 incorporated in another cap of a bottle.
Figure 5:
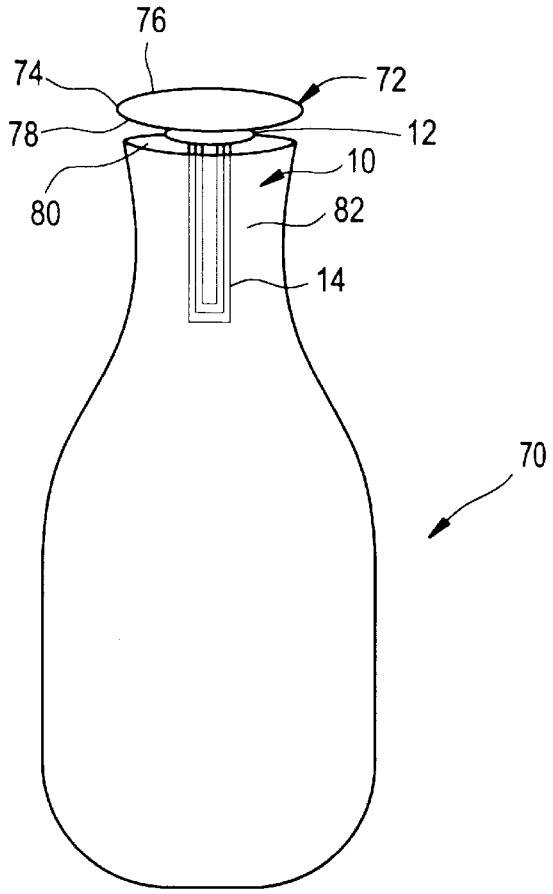
FIG. 5 shows a schematic side view of another bottle with the EAS marker and cap of FIG. 4 inserted in the neck of another bottle.

FIGS. 4 and 5 illustrate another type of cap and bottle for use with the EAS marker 10. FIG. 4 illustrates the EAS marker 10 attached to a cap 72 having a covering portion 74 with top and bottom surfaces 76 and 78. In this illustrated embodiment, the top surface 20 of the disk-shaped member 12 of the EAS marker 10 is attached or secured adjacent to the bottom surface 78 of the covering portion 74. The disk-shaped member 12 provides means for suspending the housing 14 of the marker 10 from the covering portion's bottom surface 78. The housing 14 extends substantially vertically downward from the disk-shaped member 12. The marker element disposed in the housing 14, is then insertable through an opening 80 into a neck portion 82 of the bottle 70 as shown in FIG. 5.

Figure 6:
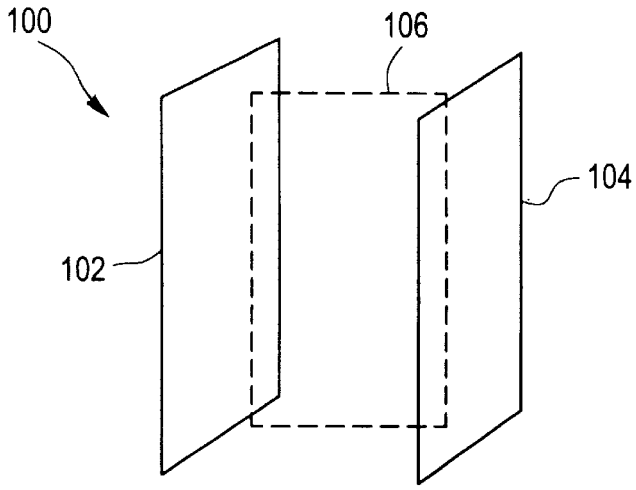
FIG. 6 shows a schematic view of an installation of conventional EAS detection equipment.

In order to show an example of detection equipment for use with the present invention, FIG. 6 is provided as an illustration with detection equipment 100 including antenna pedestals 102 and 104 defining therebetween a passage 106 for detecting unauthorized removal of a bottle with the EAS marker 10 integrated therewith.

The EAS marker 10 of the present invention, however, is not limited to its present configuration but can be a variety of different shapes and sizes. For example, an attachment portion of the EAS marker 10 can be square, rectangular or otherwise polygonal, etc., instead of disk-shaped (circular). In addition to or instead of pressure fitting the attachment portion to the bottle cap, adhesives, tape, epoxy or connectors for securing the EAS marker 10 to the cap may be used. The housing 14 may also be a variety of shapes and sizes that accommodate or support a detectable marker element and that is insertable into the opening or neck of a bottle or container.

In addition, although the present invention has been described herein with reference to a magneto-mechanical type of marker disclosed in the aforesaid Anderson et al. patent, it is contemplated according to the present invention to integrate marker elements of other types and/or other shapes in the housing 14 of the EAS marker 10. For example, it is contemplated to place in the housing 14 an element or ribbon of highly permeable magnetic material (like that disclosed in U.S. Pat. No. 4,686,516 issued to Humphrey and commonly assigned with the present application) or an integrated circuit marker capable of generating a multi-bit identification signal. The latter type of marker would be especially useful in applications in which it was desired to prevent counterfeiting as well as to deter theft. Accordingly, the multi-bit marker may advantageously be used in connection with expensive brands of champagne or perfume. It is also contemplated to apply the present invention to markers comprising a resonant circuit that is suitable for radio frequency or microwave EAS systems.

Although the invention has, up to this point, primarily been described in an embodiment suitable for use with a wine or champagne bottle, the invention can also be applied to caps for bottles containing other types of beverages, and on bottles containing fluids that are not beverages, including condiments or perfume, for example. Moreover, the invention may be used with bottles that contain non-fluid substances, including foods, pills or powders. The term "bottle", as used herein, should be understood to include containers made of plastic or other materials, in addition to glass, and is not limited to containers having a circular profile in a horizontal cross-section. Containers having, for example, horizontal cross-sections that are rectangular in profile are also to be embraced within the term "bottle", as well as any number of other geometric cross-sections and dimensions.

In all cases it is understood that the above-described arrangements and structures are merely illustrative of the many possible specific embodiments which represent applications of the present invention. Numerous and varied other configurations, can be readily devised in accordance with the principles of the present invention without departing from the spirit and scope of the invention.

What is claimed is:

1. A cap for a bottle to be protected from theft, said cap comprising:

a covering portion for covering an opening of the bottle, the covering portion having a surface and a wall extending downward from the surface and along a circumference of said surface, said wall having an inner surface; and an electronic article surveillance ("EAS") marker comprising an attachment portion and a marker element, said attachment portion positioned within a cavity defined by said inner surface of said wall and said marker element attached to and extending downward from the attachment portion, said marker element for providing a signal that is detectable by an electronic article surveillance system.

2. A cap according to claim 1, wherein said attachment portion is a disk-shaped member that is positioned in the cavity of the covering portion.

3. A cap according to claim 2, wherein said marker element comprises a magnetostrictive member and a biasing member mounted spaced apart from said magnetostrictive member, said biasing member, when magnetically biased, for causing said magnetostrictive member to be mechanically resonant when exposed to an alternating electromagnetic field generated at a selected frequency by an electronic article surveillance system.

4. A cap according to claim 3, wherein said EAS marker further comprises a housing for said magnetostrictive member and said biasing member.

5. A cap according to claim 2, wherein said marker element comprises a magnetic element.

6. A cap according to claim 5, wherein said EAS marker further comprises a support for said magnetic element.

7. A cap according to claim 2, wherein said marker element comprises a resonant circuit adapted to be responsive to radio frequency or microwave frequency signals.

8. A cap according to claim 7, wherein said EAS marker further comprises a support for said resonant circuit.

9. A cap according to claim 1, wherein said EAS marker is T-shaped.

10. A cap for a bottle to be protected from theft, said cap comprising:

a covering portion for covering an opening of the bottle, the covering portion having top and bottom surfaces; and an electronic article surveillance ("EAS") marker comprising an attachment portion and a marker element, said attachment portion attached to said bottom surface of the covering portion and said marker element attached to and extending downward from the attachment portion, said marker element for providing a signal that is detectable by an electronic article surveillance system and being insertable through the opening of the bottle.

11. A cap according to claim 10, wherein said attachment portion is a disk-shaped member having top and bottom disk surfaces, said top disk surface being attached to the bottom surface of the covering portion.

12. A cap according to claim 11, wherein said marker element comprises a magnetostrictive member and a biasing member mounted spaced apart from said magnetostrictive member, said biasing member, when magnetically biased, for causing said magnetostrictive member to be mechanically resonant when exposed to an alternating electromagnetic field generated at a selected frequency by an electronic article surveillance system.

13. A cap according to claim 12, wherein said EAS marker further comprises a housing for said magnetostrictive member and said biasing member.

14. A cap according to claim 11, wherein said marker element comprises a magnetic element.

15. A cap according to claim 14, wherein said EAS marker further comprises a support for said magnetic element.

16. A cap according to claim 11, wherein said marker element comprises a resonant circuit adapted to be responsive to radio frequency or microwave frequency signals.

17. A cap according to claim 16, wherein said EAS marker further comprises a support for said resonant circuit.

18. A cap according to claim 10, wherein said EAS marker is T-shaped.

19. An electronic article surveillance marker comprising:

an active element for providing a signal that is detectable by an electronic surveillance system;

a housing in which said active element is contained; and means for suspending said housing from a bottom surface of a bottle cap.

20. A marker according to claim 19, wherein said housing extends substantially vertically downward from said means for suspending.

21. A marker according to claim 19, wherein said means for suspending includes a disk-shaped member for being secured adjacent to said bottom surface of said bottle cap.

22. A marker according to claim 19, wherein said active element is a magnetostrictive member, said marker further comprising a biasing member mounted to said housing, said biasing member, when magnetically biased, for causing said magnetostrictive member to be mechanically resonant when exposed to an alternating electromagnetic field generated at a selected frequency by an electronic article surveillance system.

23. A method of forming a cap to cover an opening of a bottle to be protected from theft, the method comprising the steps of:

(a) providing a covering portion for covering the opening of the bottle, said covering portion having a surface and a wall extending downward from the surface and along a circumference of said surface, said wall having an inner surface; and (b) positioning an attachment portion of an electronic article surveillance ("EAS") marker within a cavity defined by said inner surface of said wall of the covering portion, said EAS marker further comprising a marker element attached to and extending downward from the attachment portion for insertion through the opening of the bottle.

24. A method according to claim 23, wherein said marker element comprises a magnetostrictive member and a biasing member mounted spaced apart from said magnetostrictive member, said biasing member, when magnetically biased, for causing said magnetostrictive member to be mechanically resonant when exposed to an alternating electromagnetic field generated at a selected frequency by an electronic article surveillance system.

25. A method according to claim 23, wherein said marker element comprises a magnetic element.

26. A method according to claim 23, wherein said marker element comprises a resonant circuit adapted to be responsive to radio frequency or microwave frequency signals.

27. A method of forming a cap to cover an opening of a bottle to be protected from theft, the method comprising the steps of:

(a) providing a covering portion for covering the opening of the bottle, said covering portion having top and bottom surfaces; and (b) attaching an attachment portion of an electronic article surveillance ("EAS") marker to the bottom surface of the covering portion, said EAS marker further comprising a marker element attached to and extending downward from the attachment portion for insertion through the opening of the bottle.

28. A method according to claim 27, wherein said marker element comprises a magnetostrictive member and a biasing member mounted spaced apart from said magnetostrictive member, said biasing member, when magnetically biased, for causing said magnetostrictive member to be mechanically resonant when exposed to an alternating electromagnetic field generated at a selected frequency by an electronic article surveillance system.

29. A method according to claim 27, wherein said marker element comprises a magnetic element.

30. A method according to claim 27, wherein said marker element comprises a resonant circuit adapted to be responsive to radio frequency or microwave frequency signals.

31. A method of securing an EAS marker to a bottle to be protected from theft, said bottle having an opening at a top of the bottle and a neck portion that extends downwardly from said opening, the method comprising the steps of:

(a) securing said EAS marker to a bottom surface of a bottle cap;

(b) inserting said EAS marker into the neck portion of said bottle; and (c) installing said bottle cap on said bottle in a position to cover said opening of said bottle.

32. A method according to claim 31, wherein said EAS marker further comprises a marker element.

33. A method according to claim 32, wherein said marker element comprises a magnetostrictive member and a biasing member mounted spaced apart from said magnetostrictive member, said biasing member, when magnetically biased, for causing said magnetostrictive member to be mechanically resonant when exposed to an alternating electromagnetic field generated at a selected frequency by an electronic article surveillance system.

34. A method according to claim 32, wherein said marker element comprises a magnetic element.

35. A method according to claim 32, wherein said marker element comprises a resonant circuit adapted to be responsive to radio frequency or microwave frequency signals.

* * * * *